US010577548B2

(12) United States Patent
Datta et al.

(10) Patent No.: US 10,577,548 B2
(45) Date of Patent: Mar. 3, 2020

(54) OXYGENATED SOLVENT AND SURFACTANT FOR HEAVY CRUDE UPGRADE

(71) Applicants: Vertec BioSolvents, Inc., Downers Grove, IL (US); PETRODAL CORPORATION S.A., Ciudad de Panama (PA)

(72) Inventors: Rathin Datta, Chicago, IL (US); Ramon Burgues, Valencia (VE); Elena Osta, Valencia (VE); James E. Opre, Downers Grove, IL (US)

(73) Assignees: PETRODAL CORPORATION S.A., Ciudad de Panama (PA); VERTEC BIOSOLVENTS, INC., Downers Grove, IL (US)

( * ) Notice: Subject to any disclaimer, the term of this patent is extended or adjusted under 35 U.S.C. 154(b) by 0 days.

(21) Appl. No.: 16/168,473

(22) Filed: Oct. 23, 2018

(65) Prior Publication Data

US 2019/0119587 A1 Apr. 25, 2019

Related U.S. Application Data

(60) Provisional application No. 62/576,399, filed on Oct. 24, 2017.

(51) Int. Cl.
*C10G 71/00* (2006.01)

(52) U.S. Cl.
CPC ..... *C10G 71/00* (2013.01); *C10G 2300/302* (2013.01); *C10G 2300/80* (2013.01)

(58) Field of Classification Search
CPC ... C10M 22/071; C10M 2290/02; C10L 1/24; C10L 1/188; C10L 1/1881; C10L 1/2412; C10L 1/328; C10L 1/18; C10L 1/10; C10L 1/14; C10L 1/183; C10G 17/00
USPC ..... 585/3, 13, 14
See application file for complete search history.

(56) References Cited

U.S. PATENT DOCUMENTS

| | | | | |
|---|---|---|---|---|
| 4,570,656 | A | 2/1986 | Matlach et al. | |
| 7,754,104 | B2 | 7/2010 | Datta et al. | |
| 8,900,332 | B2 | 12/2014 | Lee | |
| 2011/0315929 | A1 | 12/2011 | Datta et al. | |
| 2014/0338911 | A1* | 11/2014 | Dismuke | C09K 8/035 166/300 |
| 2016/0200995 | A1 | 7/2016 | Cui et al. | |

OTHER PUBLICATIONS

Search Report and Written Opinion for PCT/US2018/057106.
*Hawley's Condensed Chemical Dictionary*, 12th ed., VanNostrand Reinhold Co., NY, (1993), p. 321.
*McGraw-Hill Encyclopedia of Science & Technology*, vol. 4, (1987), pp. 494-495.
*Hawley's Condensed Chemical Dictionary*, 12th ed., VanNostrand Reinhold Co., NY, (1993), p. 461.
*Stedman's Medical Dictionary*, Houghton Mifflin Co., NY, (2002), p. 262.

* cited by examiner

*Primary Examiner* — Thuan D Dang
(74) *Attorney, Agent, or Firm* — Husch Blackwell LLP

(57) ABSTRACT

An enhanced diluent (EDIL) composition used to prepare a transportable dense crude oil composition is disclosed. An EDIL composition contains a usually used dense crude hydrocarbon diluent (DIL) plus an additive (ADD) composition that permits the amount of EDIL used in the resulting diluted transportable dense crude (EDIL:DC) to be lessened by about 20 to about 60 percent, while maintaining the viscosity and other properties of the usually used DC:DIL composition. A contemplated ADD composition is a mixture of three components, a solvent mixture, a diol and a surfactant. A contemplated EDIL composition contains about 1 to about 20 percent by weight of the ADD composition. Admixture of EDIL with a dense crude at about 80 to about 40 percent by volume of the amount of DIL usually used provides an easily transportable enhanced dense crude composition. A method of preparing a transportable dense crude composition is also disclosed.

23 Claims, No Drawings

OXYGENATED SOLVENT AND SURFACTANT FOR HEAVY CRUDE UPGRADE

CROSS-REFERENCE TO RELATED APPLICATION

This application claims priority to U.S. provisional application Ser. No. 62/576,399 filed on Oct. 24, 2017, whose disclosures are incorporated herein by reference.

BACKGROUND ART

Heavy crude oil is found in many parts of the world and often represents substantial volumes of energy resources. Some examples are: Orinoco basin in Venezuela, oilfields in Colombia, tar sands in Canada and numerous other smaller oilfields in the world. Generally, these crudes are highly viscous, bituminous materials of heterogeneous chemical and physical composition.

Heavy crude is difficult to transport as a liquid and many technologies and processes have been developed and deployed over many decades to overcome these difficulties and upgrade heavy crudes. Typically these technologies and processes involve three approaches that are sometimes used in combination:

- Use of heat (typically steam) to partially melt the crude, reduce viscosity to a transportable material;
- Use of surfactants and water to make a hydrocarbon-water emulsion that lowers the viscosity to that of a transportable material; and
- Use of a light hydrocarbon diluent (typically naphtha or light crude) that is mixed with the heavy crude, to provide a diluted stream having lower viscosity enabling transport, and the light hydrocarbon diluent (DIL) is then recovered at the refinery and returned for reuse or is processed along with the heavy crude.

A large amount of information regarding these technologies exists. That mass of information notwithstanding, these technologies suffer from drawbacks and inadequacies that can be related to infrastructure availability, energy requirements and economics, need for further separations and processing at refineries etc.

The use of hydrocarbon diluents, referred to in the art as "DIL", technology is widely practiced in Venezuela, Colombia and other Latin American countries with heavy crude fields that are located in remote areas. Typically, the Heavy Crude (HVC) to DIL ratio is about 80:20 by volume to enable viscosity reduction to provide a transportable condition. With bitumen, the amount of DIL can be about 50% by volume. Hence, a very large volume of the DIL has to be transported and brought onto the field by a pipeline or other transport such as trucks, and then the mixture has to be transported back through the pipeline or back by trucks. Furthermore, this mixture has to be separated and/or processed at the refinery. Thus, any substantial reduction in volume of the DIL required to process the HVC and similar dense crudes can provide enormous benefits.

In the nomenclature of this art, a "dilbit" is a bitumen diluted with one or more lighter petroleum hydrocarbon products, typically natural-gas condensates such as naphtha. Diluting bitumen makes it much easier to transport, for example in pipelines. According to the *Alberta Oil Sands Bitumen Valuation Methodology,* 2008-9995, Calgary, Alberta, Canadian Association of Petroleum Producers, December 2008, "Dilbit Blends" means "blends made from heavy crudes and/or bitumens and a diluent, usually natural-gas condensate, for the purpose of meeting pipeline viscosity and density specifications, where the density of the diluent included in the blend is less than 800 kg/m$^3$." A similar definition of "dilbit" is "bitumen that has been reduced in viscosity through addition of a diluent . . . such as condensate or naphtha" [*Canada's Oil Sands: Opportunities and Challenges to* 2015 (Energy Market Assessment), Calgary, Alberta, National Energy Board:115-118 (May 2004)].

The latter source defines "condensate" as "a mixture comprised mainly of pentanes and heavier hydrocarbons recovered as a liquid from field separators, scrubbers or other gathering facilities or at the inlet of a natural gas processing plant before the gas is processed." A "diluent" is there defined as "any lighter hydrocarbon, usually pentanes plus, added to heavy crude oil or bitumen in order to facilitate its transport on crude oil pipelines."

Two further definitions include "synbit" as "a blend of bitumen and synthetic crude oil that has similar properties to medium sour crude," and "synthetic crude oil is a mixture of hydrocarbons generally similar to light sweet crude oil, derived by upgrading crude bitumen or heavy crude oil." [*Canada's Oil Sands: Opportunities and Challenges to* 2015 (Energy Market Assessment), Calgary, Alberta, National Energy Board:115-118 (May 2004).]

If the diluent density is greater than or equal to 800 kg/m$^3$, the diluent is typically synthetic crude and accordingly the blend is called "synbit" [*Canada's Oil Sands: Opportunities and Challenges to* 2015 (Energy Market Assessment), Calgary, Alberta, National Energy Board:115-118 (May 2004)].

In locations other than Canada, light crude oils from natural reservoirs or naphtha are used as diluents.

Definitions

Light crude oil, also called conventional oil, has an API gravity (discussed hereinafter) of at least 22°, and preferably of about 37° API (840 kg/m$^3$) to about 42° API (816 kg/m$^3$), and a viscosity less than 100 centipoise (cP).

Heavy crude oil is an asphaltic, dense (low API gravity), and viscous oil that is chemically characterized by its content of asphaltenes (very large molecules incorporating most of the sulfur and perhaps 90 percent of the metals in the oil). Although variously defined, the upper limit for heavy oil has been set at 22° API gravity and a viscosity of 100 cP.

The World Energy Council (WEC) defines extra-heavy crude oil as that portion of heavy oil having an API gravity of less than 10° and a reservoir viscosity of no more than 10,000 cP. Where reservoir viscosity is not available, WEC considers extra-heavy crude oil to have a lower limit of 4° API and a specific gravity of more than 1 [*Survey of Energy Resources* 2007*: Natural Bitumen—Definitions*, World Energy Council, London, UK (2007)]. Measured differently, extra-heavy crude is reported to have a density greater than 1000 kg/m$^3$ [Attanasi et al., "Natural Bitumen and Extra-Heavy Oil", *Survey of Energy Resources,* 22 ed., World Energy Council: 123-140 (2010)].

Natural bitumen, also called tar sands or oil sands, shares many attributes of heavy and extra-heavy oil but is yet more dense and viscous. Natural bitumen is oil having a reservoir viscosity greater than 10,000 cP and an API density of less than 10°. Measured differently, bitumen has a density of 960-1020 kg/m$^3$.

Although heavy crude, extra-heavy crude and bitumen are or can be chemically and physically different materials, their definitions can overlap or exchange when necessary for a particular purpose. Because each of those three materials is highly viscous and can have a specific gravity greater than 1, and because each of the three must be diluted for shipment, those three materials are collectively referred to herein as "dense crude" ("DC"), unless specifically named as heavy crude, extra-heavy crude or bitumen.

Oil density can be expressed in degrees of API gravity, a standard of the American Petroleum Institute. API gravity values of most petroleum liquids fall between 10 and 70 degrees.

An oil having a specific gravity of greater than 1.0 will sink in water (API<10°), whereas an oil having a specific gravity of less than 1.0 will float on water (API>10°). [Meyer et al., *Heavy Oil and Natural Bitumen—Strategic Petroleum Resources—"Definitions"* (Report), U.S. Geological Survey Fact Sheet 70-03, (August 2003).] API gravity is computed as [141.5/sp g (SG)]—131.5, where "sp g" or "SG" is the specific gravity of the oil at 60° F.

As used herein a "diluent" or "DIL" is a light hydrocarbon used to dilute a dense crude to provide a transportable dense crude. Diluents fall into three general categories:

1) light crude oil as discussed above.

2) naphtha-based diluents—used to produce a "dilbit". Dilbit has a 650-750 kg/m$^3$ typical density for diluent natural liquids, light sweet crudes, and imported condensates. Canadian dilbit typically contains about 25 to about 30 volume percent condensate. Naphtha is described by the U.S. Centers for Disease Control and Prevention National Institute for Occupational Safety and Health (NIOSH) as a mixture of parafins [$C_5$-$C_{13}$] that may contain a small amount of aromatic hydrocarbons and having a boiling point of about 86 to about 460° F. (about 30 to about 238° C.), a freezing point of about −99° F. (about −73° C.) and a specific gravity of 0.63-0.66. In Venezuela, DC is typically diluted with naphtha and the resulting diluted DC is transported by truck.

U.S. and Canadian refinery components typically contain about a nominal 30% diluent required with 70% bitumen. A more recently introduced, less costly product for transport is referred to as "railbit" that is designed for rail rather than pipeline transport, contains about 17% diluent and about 83% bitumen, and is more viscous than dilbit.

3) light sweet synthetic crude oil (SCO)—is used to produce a "synbit". A synbit has a density greater than about 800 kg/m$^3$, and more usually about 840 to about 870 kg/m$^3$ typical density for SCO, the same as existing SCO from Alberta upgraders to refiners for more than 20 years; is residue-free, hydrotreated, and contains low sulfur. The material contains a nominal 50% synthetic crude required with 50% bitumen. Synbit typically provides a higher refinery value than dilbit (improved yield/value). [*Canada's Oil Sands Overview and Bitumen Blending Primer*, by US National Academy of Science, Canadian Association of Petroleum Producers:P12 (Oct. 23, 2012).]

Analytical data for a light sweet synthetic crude product are provided in the Tables below.

| Light Ends (Vol %)** | |
|---|---|
| Butanes | 1.13 +/− 0.17 |
| Pentanes | 2.56 +/− 0.20 |
| Hexanes | 3.57 +/− 0.30 |
| Heptanes | 3.61 +/− 0.36 |
| Octanes | 5.26 +/− 0.56 |
| Nonanes | 4.94 +/− 0.62 |
| Decanes | 2.63 +/− 0.35 |

| | 5 Year Avg. +/− Std. Dev |
|---|---|
| asic Analysis Information** | |
| Relative Density | 0.850 +/− 0.004 |
| Gravity (degrees API) | 35.1 +/− 0.8 |
| Absolute Density (kg/m$^3$) | 848.6 +/− 4.0 |
| Sulfur (mass %) | 0.07 +/− 0.02 |
| BTEX (vol %) | |
| Benzene | 0.05 +/− 0.02 |
| Toluene | 0.25 +/− 0.06 |
| Ethylbenzene | 0.18 +/− 0.02 |
| Xylenes | 0.60 +/− 0.09 |

**Crude Quality, Inc., Edmonton, Alberta, CA (2015);

**Crude Quality, Inc., Edmonton, Alberta, C A (2015);

Heavy crudes vary blend quality somewhat with seasonal temperature (for bitumen-based and conventional heavies). Pipeline designs are for 350 cSt viscosity maximum crude and 940 kg/m$^3$ density (one is constraining). Bitumen remains constant, with the diluent ratio changing. The viscosity limit of 350 centistokes (cSt) is at pipeline reference temperature of 7.5-18.5° C.=45.5-65.3° F. Density maxima of 940 kg/m$^3$ are approached in the summer and may become the limiting blend constraint for producers in the summer. An illustrative table of data and properties for synbit and dilbit is provided below.

TABLE*

| Synbit | Blend Component | Volume (m$^3$) | Density (kg/m$^3$) | vol frac (%) | wt frac (%) | Mass (kg) | Viscosity (cSt @ 15° C.) |
|---|---|---|---|---|---|---|---|
| Bitumen | Heavy | 7500 | 1.0100 | 51.7 | 55.6 | 7575 | 760,000 |
| sco | Diluent | 7003 | 0.8650 | 48.3 | 44.4 | 6058 | 5.85 |
| Synbit | Total | 14503 | 0.9400 | 100 | 100 | 13633 | 128 |
| Dilbit | | | | | | | |
| Bitumen | Heavy | 7500 | 1.0100 | 74.60 | 80.47 | 7575 | 760,000 |
| "CRW" | Diluent | 2554 | 0.7200 | 25.4 | 19.5 | 1839 | 0.63 |
| Dilbit | Total | 10054 | 0.9363 | 100 | 100 | 9414 | 350 |

*vol frac = volume fraction;
wt frac = weight fraction;
"CRW" = a fully blended aggregate of many light sweet feeder streams.

More specifically, CRW is a fully equalized crude stream, wherein above standard feeders are compensated by substandard feeders on a net zero basis. About 90% by volume of the light ends is composed of $C_5$-$C_{13}$ hydrocarbons. The CRW blend is nearly completely consumed within Alberta, Canada as a diluent in heavy crude blending. Average composition properties over a five year period of time relative to those of Apr. 4, 2015 are set out below **.

| Condensate Blend (Vol %)** | |
|---|---|
| C3 | 0.21 |
| C4 | 2.99 |
| C5 | 32.04 |
| C6 | 16.50 |
| C7 | 14.37 |
| C8 | 11.04 |
| C9 | 5.32 |
| C10 | 3.81 |
| C11 | 2.55 |
| C12 | 1.56 |
| C13 | 1.16 |
| C14 | 0.93 |
| C15 | 0.82 |
| C16 | 0.69 |
| C17 | 0.76 |
| C18 | 0.61 |
| C19 | 0.47 |
| C20 | 0.48 |
| C21 | 0.45 |
| C22 | 0.40 |
| C23 | 0.38 |
| C24 | 0.35 |
| C25 | 0.32 |
| C26 | 0.28 |
| C27 | 0.26 |
| C28 | 0.24 |
| C29 | 0.22 |
| C30+ | 0.76 |

| | 5 Year Avg. +/− Std. Dev |
|---|---|
| Basic Analysis Information** | |
| Relative Density | 0.714 +/− 0.013 |
| Gravity (degrees API) | 66.8 +/− 3.6 |
| Absolute Density (kg/m$^3$) | 713.1 +/− 13.0 |
| Sulfur (mass %) | 0.13 +/− 0.05 |
| MCR (mass %)[1] | 0.24 +/− 0.13 |
| RVP (kPa)[2] | 78.3 +/− 5.3 |
| Sediment (ppmw) | 115 +/− 82 |
| BTEX (vol %) | |
| Benzene | 0.80 +/− 0.17 |
| Toluene | 1.53 +/− 0.46 |
| Ethylbenzene | 0.16 +/− 0.17 |
| Xylenes | 1.30 +/− 0.52 |
| BTEX Total | 3.80 +/− 1.15 |

**Crude Quality, Inc., Edmonton, Alberta, CA (2015);
[1]MCR = microcarbon residue (ASTM D4530);
[2]RVP = Reid vapor pressure (ASTM D-323).

As used herein, a "transportable" dense crude composition is a DC that has been diluted sufficiently that its viscosity is lessened to the extent that it can be shipped by rail, pipeline, truck or tanker vessel, as may be desired. The specific diluent used can be naphtha, light crude oil, sweet light synthetic crude oil or similar diluent. The diluted DC is typically a liquid at 40° C.

Any beneficial technology in providing a more readily transportable dense crude (DC) composition should meet some very important criteria:

The DC:DIL ratio should be substantially reduced, while achieving the viscosity reduction and any other upgrade;

No substantial change in the chemical composition of the mixture;

Any additive must be effective at very low concentration; and

The diluted composition should be physically and chemically stable during transportation and processing.

The invention described below provides a novel composition and method for achieving the above criteria.

BRIEF SUMMARY OF THE INVENTION

The present invention contemplates an enhanced DIL (EDIL) that comprises a usually used dense crude (DC) diluent (DIL) augmented with an additive (ADD) composition. The resulting EDIL is used to dilute DC in an amount that is lessened by about 20 to about 60 percent compared to a usually used DIL, while maintaining the viscosity and other properties of the usually used DC:DIL composition. A contemplated EDIL composition is preferably homogeneous.

EDIL can be viewed as a four-part mixture, whose component amounts are most readily determined as a function of separate mixtures, although being miscible, they can be mixed in any order. The ADD composition contains three components that are mixed with two further components to form EDIL.

A first component of that ADD composition is a solvent mixture that is comprised of about 15 to about 40 volume percent of a $C_1$-$C_4$ ester of lactic acid (lactate), about 15 to about 40 volume percent of a $C_2$-$C_4$ (monohydroxy)alcohol (alcohol), and about 30 to about 60 volume percent of a $C_2$-$C_4$ hydrocarbyl ester of acetic acid (acetate). The second component is a diol that is propylene glycol (PG) and present at about 5 to about 50 volume percent of the solvent mixture. The third component is a surfactant (SURF) that is present at about 10 to about 50 weight percent of the weight of the solvent and diol together.

This admixture typically is formed by mixing at ambient temperature and pressure. This DIL additive is free of added water, although some water can be present in a minor amount as an impurity in the individual ingredients, but is not added intentionally.

A contemplated enhanced diluent (EDIL) is typically prepared by mixing an ADD can composition with the diluent. The diluent used is whatever diluent is normally used with a given DC. Thus, the DIL used can be condensate, naphtha, light sweet crude oil or light synthetic crude oil, or the like. An EDIL composition contains about 1 to about 20 percent, and preferably about 2 to about 10 percent by weight of an ADD composition.

Admixture of EDIL with a dense crude at about 80 to about 40 percent by volume of the amount of DIL usually used provides an easily transportable EDIL:DC. An EDIL:DC composition can be used, for example, as an enhanced dilbit (Edilbit), an enhanced synbit (Esynbit) or an enhanced railbit (Erailbit), whose viscosity is the same or less than that of a dilbit, synbit or railbit (collectively DIL:DC) that contains the usual, greater amount of DIL. The API gravity of the resulting EDIL:DC is the same or greater than that of a conventional DIL:DC containing the greater amount of DIL. Although there are changes in viscosity and API gravity in EDIL:DC versus DIL:DC, other properties such as flashpoint are substantially unchanged (e.g. less than 10%).

A method for lessening the viscosity of dense crude (DC) to that of a transportable diluted dense crude composition as for shipment by pipeline, truck or rail is also contemplated. In accordance with that method, dense crude is admixed with an enhanced diluent (EDIL) to form EDIL:DC as discussed above. That admixture typically occurs at ambient temperature and pressure. A contemplated EDIL is comprised of a usual shipping diluent such as condensate, naphtha, or light sweet crude or light synthetic crude oil (the last two together referred to as LSCO) admixed with a three-part additive (ADD) present at about 1 to about 20 weight percent of the final EDIL. That ADD comprises a first part solvent mixture that is comprised of about 15 to about 40 volume percent of a $C_1$-$C_4$ ester of lactic acid (lactate), about 15 to about 40 volume percent of a $C_2$-$C_4$ (monohydroxy)alcohol (alcohol), and about 30 to about 60 volume percent of a $C_2$-$C_4$ hydrocarbyl ester of acetic acid (acetate). The second component is a diol that is propylene glycol (PG) and is present at about 5 to about 50 volume percent of the solvent mixture. The third component is a surfactant (SURF) that is present at about 10 to about 50 weight percent of the weight of the solvent and diol together. The additive is free of added water.

The EDIL so prepared is admixed with the DC to provide a predetermined viscosity such as that suitable to be transportable by rail, truck or pipeline. The amount of EDIL utilized in that admixture is about 20 to about 60 volume percent less than the amount of DIL otherwise used to achieve that predetermined viscosity when measured at the same temperature.

The present invention has several benefits and advantages.

One advantage of the invention is that use of a contemplated additive when mixed with the DIL provides an enhanced OIL, EDIL, whose use enables a very substantial reduction in viscosity of the EDIL:DC mixture when compared to that of a DIL:DC mixture containing substantially the same amount of DIL.

A benefit of the invention is that the additive of the oxygenated solvents and surfactants (ADD) is used in very low concentrations and does not make any substantial change in the composition of the mixture.

Another benefit of the invention is that because the viscosity of DC can be reduced by using less EDIL than DIL, the transportation cost of providing sufficient diluent to provide a given amount of easily transportable DC is lessened.

Another advantage of the invention is that the primary chemical compositions of the oxygenated solvents are low molecular weight esters, alcohols and glycols, many of which can be derived from renewable resources leading to "green" chemistry solutions.

Still further benefits and advantages of the invention will be apparent to the worker of ordinary skill from the disclosure that follows.

DETAILED DESCRIPTION OF THE INVENTION

This invention is quite different from the prior art. The entire system is substantially non-aqueous. Prior surfactant usage in oilfield applications was primarily done in water with the goal of forming an oil/water emulsion and using that emulsion for transport. See, U.S. Pat. Nos. 4,134,415 and 6,269,881. This invention avoids oil-water emulsion systems.

The present invention contemplates use of a mixture of certain oxygenated solvents and surfactant (ADD) that when added to light hydrocarbons such as those used to dilute (DIL) dense crude (DC) forms an enhanced DIL (EDIL). Dilution of DC with EDIL leads to upgrading of the DC into a less viscous composition that can be more transported by pipeline, truck or by rail, while reducing the amount of DIL needed. Illustrative useful dilutions of dense crude are about 40 liters of EDIL per 1000 barrels of crude (about 0.025%) to about 600 liters of EDIL per 1000 barrels (about 0.40%).

The oxygenated solvents are thought to utilize their both hydrophilic and hydrophobic properties to act as bridging solvents that interact with surfactant and dense crude to provide unexpected results. Thus, use of a contemplated EDIL permits an amount of diluent required to be admixed with DC to achieve a desired viscosity to be lessened by about 20 to about 60 percent, while maintaining other properties of a usually used DC:DIL composition. The observed viscosity reduction and DC upgrade that has been achieved in this invention was unexpected.

A contemplated additive composition (ADD) is a three-part mixture, whose component amounts are most readily described as a function of separate component mixtures. Being miscible, the ADD components can be mixed in any order.

A first component of that ADD composition is a solvent mixture that is comprised of (a) about 15 to about 40, and preferably about 20 to about 30 volume percent of a $C_1$-$C_4$ hydrocarbyl ester of lactic acid (lactate), (b) about 15 to about 40, and preferably about 20 to about 30 volume percent of a $C_2$-$C_4$ (monohydroxy)alcohol (alcohol), and (c) about 30 to about 60, and preferably about 40 to about 50 volume percent of a $C_2$-$C_4$ hydrocarbyl ester of acetic acid (acetate). The second component is a diol that is propylene glycol (PG) and present at about 5 to about 50, and preferably about 10 to about 40 volume percent of the solvent mixture. The third component is a surfactant (SURF) that is present at about 10 to about 50, and preferably about 20 to about 40 weight percent of the weight of the solvent and diol together.

Looking more closely at the above components, a $C_1$-$C_4$ ester of lactic acid is preferably an ethyl ($C_2$) ester. Exemplary $C_1$-$C_4$ alcohols that can comprise the $C_1$-$C_4$ ester portion of a lactate ester include methanol, ethanol, propanol, isopropanol, allyl alcohol, butanol, 3-buten-1-ol, t-butanol and sec-butanol. Except for methanol, the $C_2$-$C_4$ alcohols of the above $C_1$-$C_4$ alcohols constitute the $C_2$-$C_4$ (monohydroxy)alcohol (alcohol) and the hydrocarbyl alcohol portion of the $C_2$-$C_4$ hydrocarbyl ester of acetic acid (acetate), respectively. Ethanol is preferred for the (monohydroxy)alcohols, whereas n-butanol is preferred as the alcohol portion of the acetate ester. Ethyl acetate is a frequently used denaturant for industrial ethanol and is typically also present at about 0.5 to about 2 percent by volume of the solvent mixture.

The diol, propylene glycol (PG), is present at about 5 to about 50, and preferably about 10 to about 40 volume percent of the solvent mixture. Thus, the ratio by volume of the three solvent mixture to PG is about 20 to about 1 to about 1 to about 1. More preferably, that volume ratio is about 7 to about 1 to about 4 to about 1.

The surfactant (SURF) that is present at about 10 to about 50, and preferably about 20 to about 40 weight percent of the total weight of the solvent and diol together. More preferably, the surfactant is present at about 20 to about 30 weight percent of the total EDIL composition.

Several surfactant types can be used in a contemplated EDIL composition. The surfactant nomenclature used herein is that utilized in the *International Cosmetic Ingredient Dictionary and Handbook*, eighth ed., Wenninger et al. eds., The Cosmetic, Toiletry, and Fragrance Association, Washington, D.C. (2000)[INCI]. The chemical name is often followed by an INCI name and/or a trademark name of a particular product.

Of the several useful types of surfactant, the linear and branched chain $C_{10}$-$C_{18}$ alkylbenzene sulfonic acid and alkali metal, alkaline earth and the mono-, di-, tri and tetra-$C_1$-$C_4$ alkyl ammonium salts are particularly preferred. Particularly preferred are the $C_{10}$-$C_{14}$ alkylbenzene sulfonic acid and sulfonate surfactants, with the $C_{12}$ (dodecyl) surfactant being most preferred.

Illustrative representatives of the preferred surfactant type are Bio-Soft S-101—linear alkyl benzene sulfonic acid 96% active (Stepan Co., Northfield, Ill.); Bio-Soft N 411—linear dodecyl benzene sulfonate—isopropyl amine salt 90% active (Stepan); Ninate® 411—branched dodecyl benzene sulfonate—isopropyl amine salt 88% active (Stepan); Bio-Soft N-300—Dodecyl benzene sulfonate—triethanol amine salt—60% active (Stepan); and Rhodacal® CA linear dodecyl benzene sulfonate—calcium salt (Solvay Chemicals, Inc., Houston Tex.).

Other useful surfactants include polyoxyethylene (2) cetyl ether (ceteth-2, Brij® 52; Croda Inc., Edison, N.J.); polyoxyethylene (4) lauryl ether (laureth-4, Brij® L4, Croda); polyoxyethylene (3) $C_{10}$-$C_{12}$ alkyl ether (Surfonic® L12-3, Huntsman Chemical Company, The Woodlands, Tex.), (polyoxyethylene (5) nonylphenylether, branched (nonoxynol-5, IGEPAL® CO-520, Solvay Chemicals, Inc.); sorbitan monopalmitate (sorbitan palmitate, Span® 40, Croda); and ethylene glycol(20)-propylene glycol(70)-ethylene glycol (20) block copolymer (poloxamer-403, Pluronic® P-123, BASF Corp.)

Cationic surfactants, which are generally mixtures of quaternary ammonium salts of benzyl $C_{12}$-$C_{18}$ alkyl dimethylammonium or diethylammonium compounds are also highly soluble in excess of 20% in the oxygenated solvent mixtures. An illustrative surfactant of this type is N—$C_{12}$-$C_{18}$ alkyl-N-benzyl-N,N-dimethylammonium chloride (also known in the art by its INCI name as benzalkonium chloride) or N—$C_{12}$-$C_{18}$ alkyl-N,N-dimethyl-N-ethylbenzylammonium chloride.

The emulsification capability of a potential emulsifier may be evaluated by considering its hydrophilic/lipophilic balance (HLB value). The HLB value, which is an approximate measure of polarity, usually ranges from 2 to about 18, although the scale continues to almost 40. The higher the number, the more polar the subject molecule. The lower the number, the less polar the subject molecule. The more polar molecules are generally more soluble in water and the less polar molecules generally more soluble in oil. An above-contemplated useful surfactant typically has a HLB number of about 5 to about 11, and more preferably about 6 to about 10.

A contemplated additive (ADD) composition is typically formed by admixture of its components at ambient temperature and pressure. This additive is free of added water, although some water can be present in a minor amount as an impurity in the individual ingredients, but is not added intentionally. Thus, an aqueous emulsion as taught in the prior art is not contemplated herein.

A contemplated enhanced diluent (EDIL) can contain about 1 to about 20 percent, and preferably about 2 to about 10 percent by weight of an ADD composition is admixed with a usually used diluent (DIL). A preparation of the EDIL is also typically carried out at ambient temperature and pressure. An EDIL composition is also preferably homogeneous, free of added water and is not an aqueous emulsion as discussed above.

Admixture of EDIL with a dense crude at about 80 to about 40 percent by volume of the amount of DIL usually used provides an easily transportable, enhanced dilbit (Edilbit), enhanced synbit (Esynbit) or enhanced railbit (Erailbit), also referred to herein as EDIL:DC, whose viscosity is the same or less than that of a dilbit, synbit or railbit (collectively DIL:DC) that contains the usual, greater amount of DIL. The API gravity of the resulting EDIL:DC is the same or, typically, greater than that of a conventional DIL:DC containing the greater amount of DIL. Although there are changes in viscosity and API gravity in EDIL:DC versus DIL:DC, other properties such as flashpoint are substantially unchanged (e.g. less than 10%).

A method of lessening the viscosity of dense crude (DC) as for shipment by pipeline, truck or rail is also contemplated. In accordance with that method, dense crude is admixed with an enhanced diluent (EDIL) to form EDIL:DC as discussed above. That admixture typically occurs at ambient temperature and pressure. A contemplated EDIL is comprised of a usual shipping diluent such as condensate, naphtha or light sweet crude or synthetic crude oil (LSCO) admixed with a three-part additive (ADD) composition present at about 1 to about 20, and preferably at about 2 to about 10 weight percent of the final EDIL.

That ADD composition comprises a first part solvent mixture that is comprised of about 15 to about 40 volume percent of a $C_1$-$C_4$ ester of lactic acid (lactate), about 15 to about 40 volume percent of a $C_2$-$C_4$ (monohydroxy)alcohol (alcohol), and about 30 to about 60 volume percent of a $C_2$-$C_4$ hydrocarbyl ester of acetic acid (acetate). The second component is a diol that is propylene glycol (PG) present at about 5 to about 50 volume percent of the solvent mixture. The third component is a surfactant (SURF) that is present at about 10 to about 50 weight percent of the weight of the solvent and diol together. The additive composition is free of added water.

The EDIL so prepared is admixed with the DC to provide a predetermined viscosity such as that suitable for transportation by rail or pipeline. The amount of EDIL utilized in that admixture is about 20 to about 60 volume percent less than the amount of DIL otherwise used to achieve that predetermined viscosity when measured at the same temperature.

ILLUSTRATIVE EXAMPLES

Example 1: Oxygenated Solvents and Surfactants—Phase Behavior and Compatibility Assays The following assays were conducted to establish that the oxygenated solvents have the capacity to dissolve large amounts of surfactants and that these surfactants maintained their ionic and other properties.

The ester and alcohol component of the solvent mixture is termed VertecBio XR (XR; Vertec BioSolvents, Inc., Downers Grove, Ill.). The typical composition is: ethyl lactate 25%, ethanol 24%, butyl acetate 50% and ethyl acetate 1% (all in % w).

The diol component is propylene glycol (PG). The illustrative oxygenated solvent mixture was 80% XR and 20% PG.

Four different surfactants (all commercially available from Stepan Company, Northfield, Ill.) were evaluated:

(1) Bio-Soft S-101—linear alkyl benzene sulfonic acid 96% active (2) Bio-Soft N 411—linear dodecyl benzene sulfonate—isopropyl amine salt 90% active (3) Ninate® 411—branched dodecyl benzene sulfonate—isopropyl amine salt 88% active (4) Bio-Soft N-300—Dodecyl benzene sulfonate—triethanol amine salt—60% active The phase behavior was evaluated at 20% and 40% (w/w) concentration by mixing the mixed solvents with the surfactant and observing in glass vials. After the phase behavior data were established, a small sample of the solvent/surfactant mixture was added to water (50:50 w/w) and the initial pH value was recorded by a pre-calibrated pH meter at room temperature. The data are summarized in the following Table 1.

TABLE 1

VertecBio ELSOL-XR and additives - Phase behavior and pH determinations

| Test # | Solvent blend ELSOL-XR + PG | Surfactant | Solvent/ surfactant ratio (w:w) | Phase behavior | Initial pH (1:1) water mixture |
|---|---|---|---|---|---|
| 1a | XR + PG | S-101 (acid) | 80:20 | Miscible - single phase | 0.72 |
| 1b | XR + PG | S-101 (acid) | 60:40 | Miscible - single phase | 0.57 |
| 2a | XR + PG | Ninate 411 (neutral) | 80:20 | Miscible - single phase | 3.60 |
| 2b | XR + PG | Ninate 411 (neutral) | 60:40 | Miscible - single phase | 3.52 |
| 3a | XR + PG | Ninate 411 (neutral) | 80:20 | Miscible - single phase | 3.60 |
| 3b | XR + PG | Ninate 411 (neutral) | 60:40 | Miscible - single phase | 3.30 |
| 4a | XR + PG | N-300 (neutral) | 80:20 | Miscible - single phase | 5.30 |
| 4b | XR + PG | N-300 (neutral) | 60:40 | Miscible - single phase | 6.15 |

These results show:

1. The surfactants are readily miscible in the oxygenated solvent blend and there is no difference between the acid and the neutralized surfactants in phase behavior in the concentration ranges that would be used in the formulations.

2. The ionic and other properties of the surfactants are maintained.

Example 2: Oxygenated Solvents and Surfactants—Heavy Crude Viscosity Reduction and Upgrade The following comparative assays were conducted on HVC; HVC+DIL and HVC+DIL+ADD (HVC+EDIL).

HVC was Venezuelan Extra-Heavy Crude; DIL was light crude/naphtha; ADD was XR 65%, PG 10% and surfactant 25% (Bio-Soft S-101—linear alkyl benzene sulfonic acid 96% active). Three samples were prepared and evaluated in triplicate.

$M1$=HVC(100)

$M2$=HVC(90)+DIL(10)

$M3$=HVC(90)+DIL(9.8)+ADD(0.2)

The kinematic viscosity was measured by ASTM method and the API gravity was measured by the API method. The flash points and residual carbon were also measured by standard methods. The results are summarized in Table 2.

TABLE 2

| SAMPLE | Kinematic Viscosity Saybolt (centistokes) @ 40° C. | API gravity | Flash Point (° C.) |
|---|---|---|---|
| M1 | 218.2 | 9.12 | 26.1 |
| M2 | 198.5 | 18.1 | 24.0 |
| M3 | 72.3 | 27.1 | 23.9 |

The above results establish very important findings:

1) The additives of the oxygenated solvents and surfactant are highly effective in very low concentrations—typically 0.2% of the additive to HVC.

2) The DIL required to reach a target viscosity can be substantially reduced—typically 50% or higher reduction is possible.

3) The API gravity test shows a desirable upgrade of the HVC.

4) The system operates primarily in a non-aqueous mode—no extraneous water is added other than what is present in the HVC, DIL and ADD.

Example 3: Comparative Property Evaluation

Several assays and analyses were run to see if there were any changes in the important chemical properties or compositions between M1, M2 and M3. These included:

fractional distillation at atmospheric pressure—ASTM D86;

IR spectroscopy of the distillation fractions and comparative analysis of the spectra; and analysis of metals and other hetero atoms such as nitrogen and sulfur.

None of these determinations showed any significant differences between the samples. The fractional distillation results are shown in Table 3. No significant differences are seen.

TABLE 3

ASTM D-86 distillation applicable to crude distillation at 760 mmHg

| Temperature Range, ° C. | M1 (HVC only) | M2 (HVC + DIL) | M3 (HVC + EDIL) |
|---|---|---|---|
| 0 | 0 | 0 | 0 |
| 50 | 0 | 0 | 0 |
| 97-100 | 3 | 5 | 4 |
| 100-150 | 12 | 13 | 15 |
| 150-210 | 15 | 18 | 17 |
| 210-251 | 16 | 19 | 15 |
| 251-298 | 25 | 20 | 22 |

The distillation fractions 97-100° C.; 100-150° C.; 150-210° C. of all the 3 samples M1, M2 and M3 were analyzed by infrared spectroscopy with wavelength between 4000 to 40 $cm^{-1}$. There were no discernable differences. There were also no discernable differences in contents of metal elements such as nickel, arsenic, vanadium, cadmium, iron and lead. Similarly, no discernable differences in contents of other heteroatoms such as nitrogen, sulfur, sodium and potassium were discerned.

Each of the patents, patent applications and articles cited herein is incorporated by reference. The use of the article "a" or "an" is intended to include one or more.

The foregoing description and the examples are intended as illustrative and are not to be taken as limiting. Still other variations within the spirit and scope of this invention are possible and will readily present themselves to those skilled in the art.

The invention claimed is:

1. A dense crude viscosity-lowering enhanced diluent (EDIL) composition that comprises a dense crude diluent (DIL) that contains about 1 to about 20 percent by weight of an additive composition (ADD), said ADD composition comprising (A) a three-part solvent mixture that is admixed with each of (B) a diol and (C) a surfactant, (A) said three-part solvent mixture comprising:

(1) about 15 to about 40 volume percent of a $C_1$-$C_4$ ester of lactic acid (lactate), (2) about 15 to about 40 volume percent of a $C_2$-$C_4$ (monohydroxy)alcohol (alcohol), and (3) about 30 to about 60 volume percent of a $C_2$-$C_4$ hydrocarbyl ester of acetic acid (acetate), (B) said diol comprising propylene glycol and present at about 5 to about 50 volume percent of the solvent mixture, and (C) a surfactant (SURF) that is present at about 10 to about 50 weight percent of the weight of the solvent and diol together, wherein said DIL and ADD are miscible, and said ADD is free of added water.

2. The EDIL composition according to claim 1, wherein said lactate is present at about 20 to about 30 volume percent of said three-part solvent mixture.

3. The EDIL composition according to claim 1, wherein said alcohol is present at about 20 to about 30 volume percent of said three-part solvent mixture.

4. The EDIL composition according to claim 1, wherein said acetate is present at about 40 to about 50 volume percent of said three-part solvent mixture.

5. The EDIL composition according to claim 1, wherein said diol is present at about 10 to about 40 volume percent of said three-part solvent mixture.

6. The EDIL composition according to claim 1, wherein said SURF is present at about 20 to about 40 weight percent of said three-part solvent mixture plus diol together.

7. The EDIL composition according to claim 1, wherein said SURF has an HLB of about 5 to about 11.

8. The EDIL composition according to claim 1, wherein said SURF is selected from one or more of the group consisting of a linear or branched chain $C_{10}$-$C_{18}$ alkylbenzene sulfonic acid and an alkali metal, alkaline earth or mono-, di-, tri or tetra-$C_1$-$C_4$ alkyl ammonium salt thereof, polyoxyethylene (2) cetyl ether, polyoxyethylene (4) lauryl ether, polyoxyethylene (3) $C_{10}$-$C_{12}$ alkyl ether, polyoxyethylene (5) nonylphenylether, sorbitan monopalmitate, ethylene glycol(20)-propylene glycol(70)-ethylene glycol(20) block copolymer, N—$C_{12}$-$C_{18}$ alkyl-N-benzyl-N,N-dimethylammonium chloride and N—$C_{12}$-$C_{18}$ alkyl-N,N-dimethyl-N-ethylbenzyl-ammonium chloride.

9. The EDIL composition according to claim 1, wherein said ADD composition is present at about 2 to about 10 percent by weight.

10. The EDIL composition according to claim 1 that contains naphtha.

11. A transportable dense crude composition that comprises dense crude and a viscosity-lowering enhanced diluent (EDIL) composition of claim 1, said EDIL composition being present at a concentration that is about 80 to about 40 percent of the volume required to provide a transportable viscosity to the dense crude when a DIL is used alone to provide a transportable viscosity.

12. The transportable dense crude composition according to claim 11, wherein said dense crude is an extra heavy crude oil or bitumen having an API gravity of less than 10°.

13. The transportable dense crude composition according to claim 11, wherein said dense crude is a heavy oil having an API gravity of 22° or less.

14. The transportable dense crude composition according to claim 11, wherein naphtha is used as the diluent in said EDIL.

15. A method for preparing a transportable dense crude composition that comprises the steps of: admixing a dense crude with a viscosity lowering amount of an enhanced diluent (EDIL) composition of claim 1, said EDIL volume being about 40 to about 80 percent the volume of diluent required to achieve a transportable viscosity to the dense crude if DIL were used as the sole diluent.

16. The method according to claim 15, wherein said EDIL contains about 2 to about 10 weight percent of said additive.

17. The method according to claim 15, wherein said lactate is present at about 20 to about 30 volume percent of said three-part solvent mixture.

18. The method according to claim 15, wherein said alcohol is present at about 20 to about 30 volume percent of said three-part solvent mixture.

19. The method according to claim 15, wherein said acetate is present at about 40 to about 50 volume percent of said three-part solvent mixture.

20. The method according to claim 15, wherein said diol is present at about 10 to about 40 volume percent of said three-part solvent mixture.

21. The method according to claim 15, wherein said SURF is present at about 20 to about 40 weight percent of said three-part solvent mixture plus diol together.

22. The method according to claim 15, wherein said SURF has an HLB of about 5 to about 11.

23. The method according to claim 15, wherein said SURF is selected from one or more of the group consisting of a linear or branched chain $C_{10}$-$C_{18}$ alkylbenzene sulfonic acid and an alkali metal, alkaline earth or mono-, di-, tri or tetra-$C_1$-$C_4$ alkyl ammonium salt thereof, polyoxyethylene (2) cetyl ether, polyoxyethylene (4) lauryl ether, polyoxyethylene (3) $C_{10}$-$C_{12}$ alkyl ether, polyoxyethylene (5) nonylphenylether, sorbitan monopalmitate, ethylene glycol(20)-propylene glycol(70)-ethylene glycol(20) block copolymer, N—$C_{12}$-$C_{18}$ alkyl-N-benzyl-N,N-dimethylammonium chloride and N—$C_{12}$-$C_{18}$ alkyl-N,N-dimethyl-N-ethylbenzyl-ammonium chloride.

* * * * *